US010865623B2

(12) United States Patent
Baudoin

(10) Patent No.: US 10,865,623 B2
(45) Date of Patent: Dec. 15, 2020

(54) LATERAL PROPULSION APPARATUS AND METHOD FOR USE IN A WELLBORE

(71) Applicant: KLX Energy Services LLC, Houston, TX (US)

(72) Inventor: Toby Scott Baudoin, Rayne, LA (US)

( * ) Notice: Subject to any disclaimer, the term of this patent is extended or adjusted under 35 U.S.C. 154(b) by 158 days.

(21) Appl. No.: 16/057,899

(22) Filed: Aug. 8, 2018

(65) Prior Publication Data

US 2019/0048689 A1 Feb. 14, 2019

Related U.S. Application Data

(60) Provisional application No. 62/542,668, filed on Aug. 8, 2017.

(51) Int. Cl.

| | |
|---|---|
| ***E21B 41/00*** | (2006.01) |
| ***E21B 23/04*** | (2006.01) |
| ***E21B 23/00*** | (2006.01) |

(52) U.S. Cl.

CPC ..... *E21B 41/0078* (2013.01); *E21B 23/001* (2020.05); *E21B 23/04* (2013.01)

(58) Field of Classification Search

CPC ..... E21B 23/08; E21B 2023/008; E21B 41/0078; E21B 7/065; E21B 4/18; E21B 23/001; E21B 23/04

See application file for complete search history.

(56) References Cited

U.S. PATENT DOCUMENTS

| | | | | |
|---|---|---|---|---|
| 2,932,836 | A * | 4/1960 | Pletcher | E21B 41/0078 15/104.12 |
| 3,844,362 | A * | 10/1974 | Elbert | B08B 9/0497 175/94 |
| 4,850,440 | A * | 7/1989 | Smet | E21B 7/065 175/67 |
| 4,883,355 | A * | 11/1989 | Saghatchi | E21B 23/08 356/241.6 |
| 6,470,978 | B2 * | 10/2002 | Trueman | E21B 7/061 175/67 |
| 6,607,607 | B2 * | 8/2003 | Walker | B08B 9/0433 134/18 |
| 6,866,106 | B2 * | 3/2005 | Trueman | G01N 33/6863 175/67 |
| 7,011,158 | B2 * | 3/2006 | Davis | B08B 9/0433 166/177.7 |
| 7,655,096 | B2 * | 2/2010 | Walker | B08B 9/0433 134/10 |
| 9,145,738 | B2 * | 9/2015 | Mazarac | E21B 7/18 |
| 9,376,874 | B2 | 6/2016 | Reimers | |

(Continued)

FOREIGN PATENT DOCUMENTS

| | | | | |
|---|---|---|---|---|
| GB | 2276927 A | * | 10/1994 | B08B 9/0497 |
| GB | 2350630 A | * | 12/2000 | B08B 9/0497 |
| GB | 2434819 A | * | 8/2007 | E21B 43/124 |

*Primary Examiner* — Jennifer H Gay

(74) *Attorney, Agent, or Firm* — Diana M. Sangalli; Duane Morris LLP

(57) ABSTRACT

A lateral propulsion apparatus positioned onto a drillstring comprising a tubular housing, venturi nozzles, an impeller, and flow ports. The apparatus utilizes both the venturi effect as well as rotational forces to cause wellbore fluid to travel from an area of high pressure near a lower end toward an area of lower pressure near an upper end urging the apparatus further into a non-vertical wellbore.

13 Claims, 2 Drawing Sheets

(56) References Cited

U.S. PATENT DOCUMENTS

| | | | | |
|---|---|---|---|---|
| 2002/0011357 | A1* | 1/2002 | Trueman | E21B 7/065 175/67 |
| 2003/0164253 | A1* | 9/2003 | Trueman | E21B 4/18 175/67 |
| 2011/0079397 | A1* | 4/2011 | Ayasse | E21B 7/18 166/369 |
| 2012/0228033 | A1* | 9/2012 | Mazarac | E21B 7/18 175/67 |
| 2017/0159384 | A1* | 6/2017 | Romer | E21B 23/14 |
| 2019/0048689 | A1* | 2/2019 | Baudoin | E21B 41/0078 |

* cited by examiner

LATERAL PROPULSION APPARATUS AND METHOD FOR USE IN A WELLBORE

CROSS-REFERENCE TO RELATED APPLICATIONS

This application claims the benefit of U.S. Provisional Patent Application No. 62/542,668, entitled "Lateral Propulsion Apparatus and Method," filed on Aug. 8, 2017, which is hereby expressly incorporated herein by reference in its entirety.

FIELD OF THE DISCLOSURE

The present disclosure relates generally to downhole equipment for hydrocarbon wells. More particularly, it relates to an apparatus and method to facilitate the advancement of a wellbore pipestring or bottom hole assembly (BHA) into a wellbore.

BACKGROUND OF THE INVENTION

Hydrocarbon fluids such as oil and natural gas are obtained from a subterranean geologic formation, referred to as a reservoir, by drilling a well that penetrates the hydrocarbon-bearing formation. During the advancement or manipulation of a pipe string (e.g., a drillstring, coil tubing string, a bottom hole assembly, etc.) in a non-vertical wellbore (e.g., a lateral, horizontal or deviated wellbore) or a deep wellbore, the pipe string often is vibrated or oscillated as an aid in overcoming frictional forces between the pipe string and the interior surface of the wellbore. Vibrations convert a portion of the static frictional forces to kinetic frictional forces. However, as the lateral and vertical lengths of wellbores grow longer, vibrational tools are insufficient to allow operators to move the pipe string along these extended distances.

SUMMARY

The following introduces a selection of concepts in a simplified form in order to provide a foundational understanding of some aspects of the present disclosure. The following is not an extensive overview of the disclosure, and is not intended to identify key or critical elements of the disclosure or to delineate the scope of the disclosure. The following merely presents some of the concepts of the disclosure as a prelude to the more detailed description provided thereafter.

According to an embodiment, an apparatus for advancing a pipe string in a well bore is disclosed. The apparatus includes a housing configured for attachment to a pipe string deployed in a wellbore. The housing has a longitudinal passageway extending between a first end and a second end. The apparatus also includes a restrictor device disposed in the housing to restrict fluid flow through the passageway between the first and second ends of the housing and provide a path for fluid to exit the passageway at the second end of the housing. The apparatus further includes a venturi nozzle disposed in the housing to provide a path for fluid to exit the passageway through a corresponding exit port formed through a sidewall of the housing between the first and second ends. A first portion of the fluid exits the passageway through the venturi nozzle and the exit port, and a second portion of the fluid exits the passageway through the restrictor device, therefore urging the pipe string further into the wellbore.

According to another embodiment, an apparatus for advancing a pipe string in a well bore includes a housing for attachment to a pipe string. The housing has a longitudinal passageway that extends between first and second ends. The apparatus also includes an impeller disposed in the housing that is in fluid communication with a suction port and an exit port formed through a sidewall of the housing. Rotation of the impeller about the longitudinal axis of the housing draws wellbore fluid into the housing through the suction port, around the impeller and out of the housing through the exit port to thereby urge the pipe string further into the wellbore.

According to another embodiment, a method is provided for advancing a pipe string in a wellbore. The method includes connecting a lateral propulsion tool within a pipe string, the lateral propulsion tool comprising a housing and a restrictor device disposed in the housing to restrict fluid flow through a passageway that extends between first and second ends of the housing and provide a path for fluid to exit the passageway at the second end of the housing. The tool also includes a venturi nozzle disposed in the housing to provide a path for fluid to exit the passageway through a corresponding exit port formed through a sidewall of the housing between the first end and the second end. The method comprises deploying the pipe string in a wellbore, and circulating fluid from the surface through the pipe string, wherein a first portion of the fluid entering the passageway at the first end of the housing exits the passageway through the venturi nozzle and the exit port and a second portion of the fluid entering the passageway at the first end of the housing exits the passageway at the second end through the restrictor device, thereby urging the pipe string further into the wellbore.

According to yet another embodiment, a method is provided for advancing a pipe string in a wellbore. The method comprises connecting a lateral propulsion tool within a pipe string. The tool includes comprising: a housing having a longitudinal passageway that extends between a first end and a second end of the housing, and a suction port and an exit port formed through a sidewall of the housing. The tool also includes an impeller disposed in the housing and in fluid communication with the suction port and the exit port. The method further comprises deploying the pipe string in a wellbore, and rotating the impeller about the longitudinal axis of the housing to draw wellbore fluid into the suction port, around the impeller and out of the housing through the exit port, thereby urging the pipe string further into the wellbore.

BRIEF DESCRIPTION OF THE DRAWINGS

Certain embodiments of the invention are described with reference to the accompanying drawings, wherein like reference numerals denote like elements. It should be understood, however, that the accompanying drawings illustrate only the various implementations described herein and are not meant to limit the scope of various technologies described herein. Various embodiments of the current invention are shown and described in the accompanying drawings of which.

Figure 1:
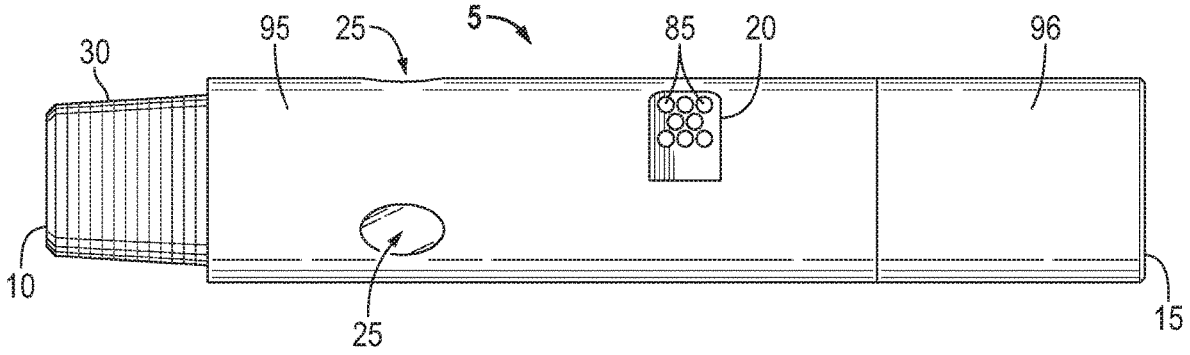
FIG. 1 is an elevation view of a lateral propulsion apparatus tool, according to an embodiment.

Embodiments of the present disclosure and their advantages are best understood by referring to the detailed description that follows. It should be appreciated that like reference numbers are used to identify like elements illustrated in one or more of the figures, wherein showings therein are for purposes of illustrating embodiments of the present disclosure and not for purposes of limiting the same.

DETAILED DESCRIPTION

Various examples and embodiments of the present disclosure will now be described. The following description provides specific details for a thorough understanding and enabling description of these examples. One of ordinary skill in the relevant art will understand, however, that one or more embodiments described herein may be practiced without many of these details. Likewise, one skilled in the relevant art will also understand that one or more embodiments of the present disclosure can include other features and/or functions not described in detail herein. Additionally, some well-known structures or functions may not be shown or described in detail below, so as to avoid unnecessarily obscuring the relevant description.

Certain terms are used throughout the following description to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion, the terms "including" and "comprising" are used in an open-ended fashion, and thus should be interpreted to mean "including, but not limited to." Also, the term "couple" or "couples" is intended to mean either an indirect or direct connection. Thus, if a first device couples to a second device, that connection may be through a direct connection, or through an indirect connection via other devices, components, and connections. Any reference to up or down in the description is made for purposes of clarity, with "up", "upper", "upwardly", or "upstream" meaning toward the surface of the borehole and with "down", "lower", "downwardly", "downhole", or "downstream" meaning toward the terminal end of the borehole, regardless of the borehole orientation.

Known vibrational or other downhole devices are inadequate in sufficiently reducing the friction between a pipe string and the surface of a wellbore so that operators can achieve desired non-vertical wellbore lengths or extended vertical depths. Accordingly, an lateral propulsion apparatus (LPA) tool is disclosed here to aid in propelling (or pulling) pipe string into wellbores for greater distances or depths that can be achieved with known vibrational devices.

Embodiments of the LPA tool disclosed herein utilize the venturi effect, an impeller or a combination of both to propel or pull a pipe string into a wellbore. The venturi effect is well known; it creates a pressure differential as fluid is pumped through a restriction such as an orifice or nozzle. In embodiments that employ the venturi effect, the LPA tool uses fluid pumped from the surface to travel through one or more nozzles mounted in the housing of the tool to create an area of low pressure in the upper portion of the tool, thereby causing wellbore fluid to travel from the lower portion of the tool (area of high pressure) towards the upper portion (area of low pressure). This pressure differential creates a downward pulling or suction force that aids in propelling a pipe string deeper into a wellbore and/or further along a non-vertical portion of a wellbore.

Embodiments of the LPA tool can also include an impeller, alone or functioning in conjunction with venturi nozzle(s), to further aid in the propulsion of the pipe string. This impeller can be similar in structure and operation to impellers that are used in pumps, compressors, watercraft, turbines, etc. and can be of various forms, shapes, styles, sizes, pitch, materials, etc. In the embodiments disclosed herein, the impeller can be an integral part of the LPA tool and is rotated via the rotation of the pipe string or a downhole motor (e.g., a downhole mud motor) in a known manner. The rotation of the pipe string forces wellbore fluid to enter an inlet end of the impeller and exit an outlet end. The movement of the wellbore fluid across the impeller also aids in the propulsion of the pipe string into the wellbore.

Embodiments that include the combination of venturi nozzle(s) and an impeller further enhance the propulsion of the pipe string. In such embodiments, the venturi nozzle(s) are located above the impeller (i.e., closer to the surface while in a wellbore), thereby aiding in the movement of wellbore fluid across the impeller. The venturi effect creates a low pressure at the nozzle(s), drawing fluid from the inlet side of the impeller towards the exit side (from the LPA's lower end toward the upper end). This movement of wellbore fluid generates a suction on the lower end of the apparatus, thus pulling the pipe string into the wellbore. As a consequence, use of the LPA tool enables operators to drill longer non-vertical wellbore sections or achieve greater depths and/or perform other functions at those extended lengths or depths.

Figure 2:
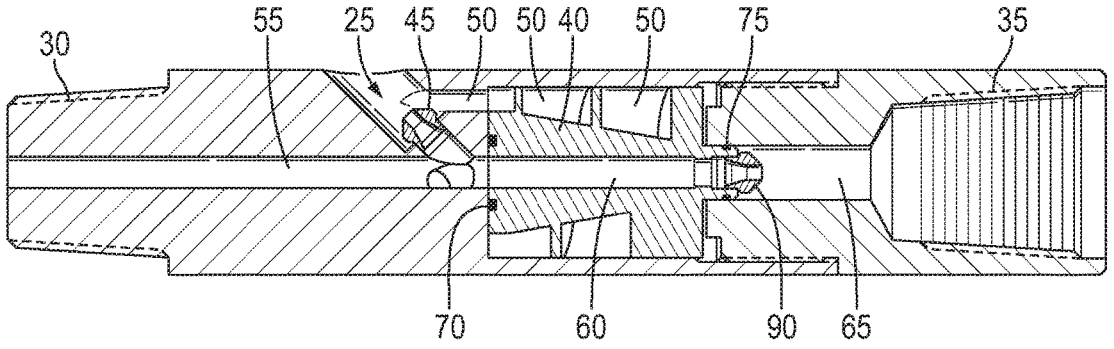
FIG. 2 is a cross-sectional view of the lateral propulsion apparatus tool of FIG. 1, according to an embodiment.
Figure 3:
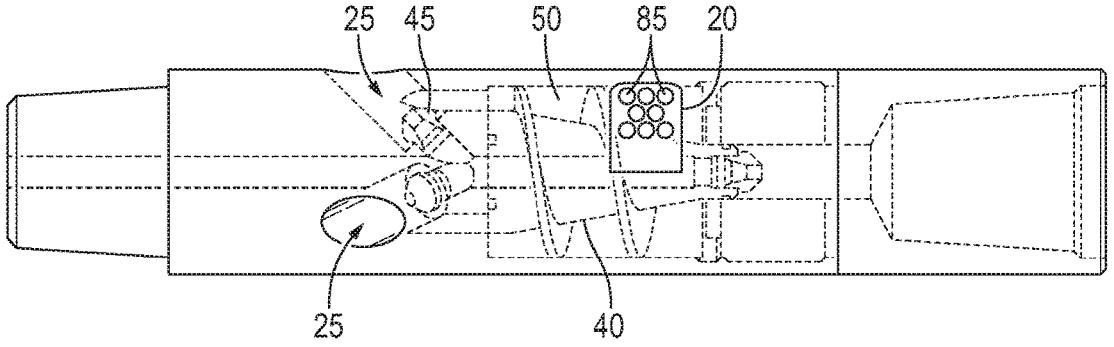
FIG. 3 is an elevation view of the lateral propulsion apparatus tool of FIG. 1, showing internal features in dashed lines, according to an embodiment.
Figure 4:
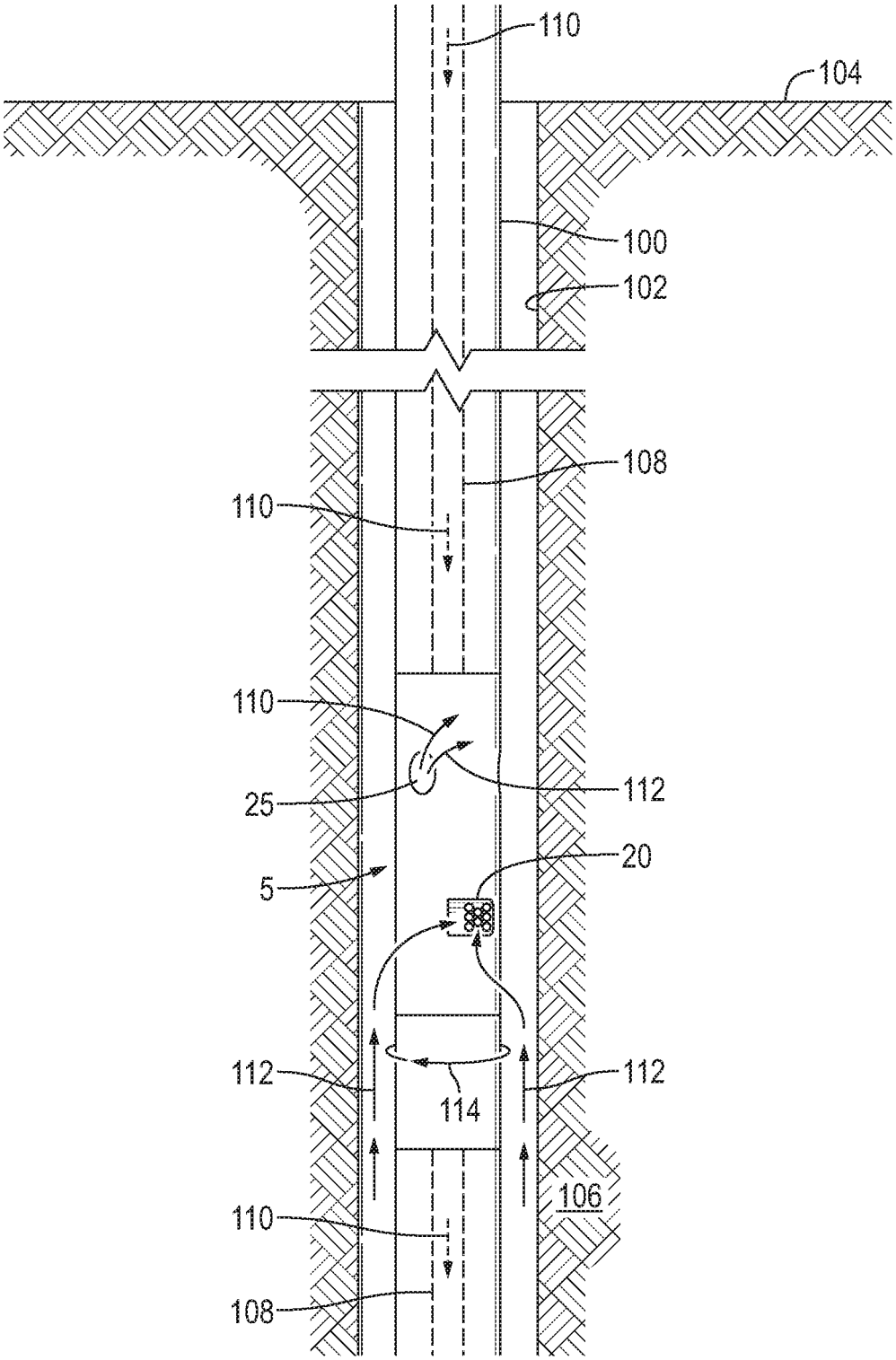
FIG. 4 shows the lateral propulsion apparatus tool of FIG. 1 connected in a pipe string that is deployed in a wellbore, according to an embodiment The headings provided herein are for convenience only and do not necessarily affect the scope or meaning of what is claimed in the present disclosure.

FIGS. 1-3 show an exemplary LPA tool 5 according to an embodiment. FIG. 4 illustrates the LPA tool 5 coupled within a pipe string 100 and deployed in a wellbore 102 that extends from a surface 104 to penetrate a region of interest 106 (e.g., a hydrocarbon-bearing formation). Although the vertical section of the wellbore 102 is shown in FIG. 4, it should be understood that the wellbore 102 also can include non-vertical sections. As will be described below, the LPA 5 can be used to assist with the propulsion of the pipe string 100 to increased vertical depths as well as increased distances along non-vertical, deviated or lateral sections of the wellbore 102.

As illustrated in FIGS. 1-3, the LPA 5 is configured for threadable attachment (e.g., via threaded connections 30 and 35 at ends 10 and 15) to the pipe string 100 (e.g., a drillstring, coil tubing string, or downhole mud motor assembly, as examples) that is deployed in the wellbore 102. The pipe string 100 includes a central bore 108 through which fluid 110 can be introduced and circulated. The LPA 5 is positioned within and threadably attached to the pipe string 100 with the LPA 5 extending longitudinally along the axis of the pipe string 100.

For ease of description, the LPA 5 has an upper end 10 and a lower end 15. LPA 5 includes a housing, which can include an upper housing portion 95 and a lower housing portion 96, an impeller 40, one or more venturi nozzle(s) 45, and a restrictor 90. In the embodiment illustrated, the upper housing portion 95 includes exit port(s) 25 and a suction inlet 20 that extend through the sidewall of the housing portion 95. Housings portions 95 and 96 are illustrated as individual components for ease of manufacture and assembly, but it should be understood that the LPA 5 can have fewer (i.e., one) or more housing portions. The LPA 5 also includes an upper bore section 55 that is in fluid communication with the bore 108 of the pipe string 100. The upper bore section 55 terminates at a restrictor 90 that is in fluid communication with a lower bore section 65 of the LPA 5. The LPA 5 also includes one or more venturi nozzles 45 in fluid communication with the upper bore section 55.

In the embodiment illustrated, the LPA 5 also includes the suction inlet 20 with suction inlet openings 85 that are in fluid communication with a passageway 50. The passageway 50 provides a fluid path between the suction inlet 20 and the exit port 25. The embodiment of the LPA 5 shown in FIGS. 1-3 also includes an impeller 40 arranged so that fluid flowing in the passageway 50 between suction inlet 20 and exit port 25 flows over the impeller 40 and assists in the rotation of the impeller 40. Other embodiments of the LPA 5 may not include the impeller 40.

With reference again to FIGS. 1-4, fluid 110 is circulated through the pipe string 100 by pumping from the surface 104. Circulated fluid 110 entering the upper bore section 55 of LPA 5 exits through either venturi nozzle(s) 45/exit ports 25 or the restrictor 90. The size of the orifices in venturi nozzle(s) 45, the number of venturi nozzle(s) 45/exit ports 25, and the orifice size of the restrictor 90 determines the amount of fluid 110 that is forced through the venturi nozzle(s) 45 versus the amount of fluid 110 that is allowed to flow through the LPA 5 via the lower bore section 65 in the lower housing section 96. In embodiments, the LPA 5 can include more than one restrictor 90.

The orifice sizes of the venturi nozzle(s) 45 and restrictor(s) 90, as well as flowrate and fluid density of fluid 110, determine the pressure drop created within LPA 5. This pressure drop creates an area of low pressure in exit port(s) 25. Consequently, high pressure wellbore fluid 112 in wellbore 102 near the suction inlet 20 will be drawn into LPA 5 through suction inlet opening(s) 85, through the passageway 50 and will exit the LPA 5 through the exit port(s) 25.

In embodiments of the LPA 5 that include the impeller 40, the wellbore fluid 112 is drawn around impeller 40 through passageway 50, and then exits port(s) 25. The movement of wellbore fluid 112 from a lower section of the LPA 5 toward the upper section of the LPA 5 will tend to pull LPA 5 downward, or deeper into a wellbore 102. The magnitude of the pressure drop created by venturi nozzle(s) 45 determines how much wellbore fluid 112 is drawn into suction opening 20, basically a measure of its "suction". The orifice sizes of the venturi nozzle(s) 45 and restrictor 90 can be adjusted to meet pressure drop requirements for particular applications.

The LPA 5 is also configured to be used in rotating applications whereby wellbore fluid 112 is forced into inlet opening(s) 85 as the LPA 5 rotates. As illustrated in FIG. 4, clockwise rotation (arrow 114) of LPA 5 urges wellbore fluid 112 towards suction inlet 20, through inlet openings 85, around impeller 40, through passage(s) 50, and exiting through port(s) 25. The rotation of the impeller 40 draws in wellbore fluid 112 from the lower portion toward the upper portion of the LPA 5, again pulling LPA 5 downward, or deeper or further into the wellbore 102. Again, as mentioned above, the LPA 5 can be configured with either the venturi nozzle(s) 45 or the impeller 40 alone to propel the pipe string 100, or the LPA 5 can include a combination of the venturi nozzle(s) 45 and the impeller 40.

The utilization of the venturi nozzle(s) 45 in conjunction with impeller 40 creates a synergistic effect in which the propulsion produced is greater than the sum of the propulsion that can be produced by the nozzle(s) 45 or the impeller 45 alone.

In the embodiment illustrated in FIGS. 1-3, the venturi nozzle(s) 45 are oriented in an upward direction. Due to this orientation, the reaction forces from fluid 110/112 exiting port(s) 25 will push the LPA 5 downward, deeper or further along the wellbore 102. In addition, the upward orientation urges cuttings or debris in wellbore 102 upwards toward the surface 104 so that they can be removed. In embodiments, venturi nozzle(s) 45 can be oriented in a tangential direction, as well as upwards, to also urge the LPA 5 to rotate in the clockwise direction 114, thereby reducing torque requirements placed upon the pipe string 100. The rotation can also cause a swirling or whirlpool effect upon the cuttings to aid in removal.

The impeller 40 can be of various shapes, sizes, pitch, length, style, number of blades, etc. These attributes of impeller 40 are selected based on the needs of the specific application in which the LPA 5 is employed. Therefore, it should be understood that the impeller 40 shown in FIGS. 1-3 is illustrative only and does not limit the scope of this disclosure. As shown, the impeller 40 includes a central fluid passageway 60. The impeller 40 also can include an upper sealing element 70 and/or lower sealing elements 75 and can be similar in configuration to impellers used in centrifugal pumps, turbines, jet skis or other watercraft, etc.

In one application, the LPA 5 can be used solely on a drillstring 100 where rotation is produced via a power swivel, drilling rig rotary, or other surface devices commonly found on drilling or workover rigs in oil and gas operations. In this type of application, considered conventional drilling, a drill bit can be directly attached to the lower thread 35 of LPA 5. The entire drillstring 100 as well as LPA 5 will be rotated while in use.

In another application, the LPA 5 can be utilized in conjunction with a bottom hole assembly (BHA) (i.e., in conjunction with other downhole tools), whereby rotation is produced via a downhole motor (e.g., a downhole mud motor). These types of applications generally utilize coil tubing which cannot be rotated from surface, and thus rely on rotation produced from the downhole motor that converts fluid energy from circulated fluid 100 into rotational energy.

For the purposes of promoting an understanding of the principles of the invention, reference has been made to the embodiments illustrated in the drawings, and specific language has been used to describe these embodiments. However, no limitation of the scope of the invention is intended by this specific language, and the invention should be construed to encompass all embodiments that would normally occur to one of ordinary skill in the art. Descriptions of features or aspects within each embodiment should typically be considered as available for other similar features or aspects in other embodiments unless stated otherwise. The terminology used herein is for the purpose of describing the particular embodiments and is not intended to be limiting of exemplary embodiments of the invention.

The use of any and all examples, or exemplary language (e.g., "such as") provided herein, is intended merely to better illuminate the invention and does not pose a limitation on the scope of the invention unless otherwise claimed. Numerous modifications and adaptations will be readily apparent to those of ordinary skill in this art without departing from the scope of the invention as defined by the following claims.

Therefore, the scope of the invention is not confined by the detailed description of the invention but is defined by the following claims.

What is claimed is:

1. An apparatus for advancing a pipe string in a wellbore extending from an earth surface to penetrate a hydrocarbon-bearing formation, comprising:

a housing configured for threadable attachment to the pipe string deployed in the wellbore, the housing having a longitudinal passageway that extends between a first end and a second end of the housing;

a restrictor device disposed in the housing to restrict fluid flow through the passageway between the first and second ends of the housing and provide a path for fluid to exit the passageway at the second end of the housing;

a venturi nozzle disposed in the housing to provide a path for fluid to exit the passageway through a corresponding exit port formed through a sidewall of the housing between the first end and the second end, wherein a first portion of the fluid entering the passageway at the first end of the housing exits the passageway through the venturi nozzle and the exit port to thereby urge the pipe string further into the wellbore, and wherein a second portion of the fluid entering the passageway at the first end of the housing exits the passageway at the second end through the restrictor device; and an impeller disposed in the housing between the restrictor device and the venturi nozzle, wherein the impeller is in fluid communication with a suction port formed through the sidewall of the housing, wherein rotation of the impeller within the housing draws wellbore fluid into the housing through the suction port, around the impeller and out of the housing through the exit port.

2. The apparatus as recited in claim 1, wherein the venturi nozzle is angularly oriented towards the first end of the housing so that fluid exiting the venturi nozzle is directed toward the earth surface.

3. The apparatus as recited in claim 2, wherein the apparatus includes a second venturi nozzle that is oriented tangential to the housing so that fluid exiting the second venturi nozzle urges rotation about the longitudinal axis of the apparatus.

4. The apparatus as recited in claim 1, wherein the suction port includes a plurality of suction inlets.

5. An apparatus for advancing a pipe string in a wellbore extending from an earth surface to penetrate a hydrocarbon-bearing formation, comprising:

a housing configured for threadable attachment to the pipe string deployed in the wellbore, the housing having a longitudinal passageway that extends between a first end and a second end of the housing;

a restrictor device disposed in the housing to restrict fluid flow through the passageway between the first and second ends of the housing and provide a path for fluid to exit the passageway at the second end of the housing; and a venturi nozzle disposed in the housing to provide a path for fluid to exit the passageway through a corresponding exit port formed through a sidewall of the housing between the first end and the second end, wherein a first portion of the fluid entering the passageway at the first end of the housing exits the passageway through the venturi nozzle and the exit port to thereby urge the pipe string further into the wellbore, and wherein a second portion of the fluid entering the passageway at the first end of the housing exits the passageway at the second end through the restrictor device, wherein the pipe string is a drillstring that is rotated from the earth surface so that the housing rotates.

6. An apparatus for advancing a pipe string in a well bore, comprising:

a housing configured for threadable attachment to the pipe string deployed in the wellbore, the housing having a longitudinal passageway that extends between a first end and a second end of the housing; and an impeller disposed in the housing and in fluid communication with a suction port and an exit port formed through a sidewall of the housing, wherein rotation of the impeller about the longitudinal axis of the housing draws wellbore fluid into the housing through the suction port, around the impeller and out of the housing through the exit port to thereby urge the pipe string further into the wellbore.

7. The apparatus as recited in claim 6, wherein the passageway is in fluid communication with a longitudinal bore of the pipe string through which fluid is pumped through the pipe string from the first end toward the second end of the housing, and the apparatus further comprises:

a restrictor device disposed in the housing to restrict fluid flow through the passageway between the first and second ends of the housing and provide a path for fluid to exit the passageway at the second end of the housing; and a venturi nozzle disposed in the housing and in fluid communication with the exit port, wherein a first portion of the fluid entering the passageway at the first end of the housing exits the passageway through the venturi nozzle and the exit port in combination with the wellbore fluid that is drawn into the housing, and wherein a second portion of the fluid entering the passageway at the first end of the housing exits the passageway at the second end through the restrictor device.

8. The apparatus as recited in claim 7, wherein the venturi nozzle is angularly oriented towards the first end of the housing so that fluid exiting the venturi nozzle is directed toward the earth surface.

9. The apparatus as recited in claim 8, wherein the apparatus includes a second venturi nozzle that is oriented tangential to the housing so that fluid exiting the second venturi nozzle urges rotation about the longitudinal axis of the apparatus.

10. The apparatus as recited in claim 6, wherein the suction port includes a plurality of suction inlets.

11. The apparatus as recited in claim 6, wherein the pipe string is a drillstring that is rotated from the earth surface so that the housing rotates.

12. A method of advancing a pipe string in a wellbore extending from a surface into a region of interest, comprising:

connecting a lateral propulsion tool within the pipe string, the lateral propulsion tool comprising:

a housing having a longitudinal passageway that extends between a first end and a second end of the housing;

a restrictor device disposed in the housing to restrict fluid flow through the passageway between the first and second ends of the housing and provide a path for fluid to exit the passageway at the second end of the housing;

a venturi nozzle disposed in the housing to provide a path for fluid to exit the passageway through a corresponding exit port formed through a sidewall of the housing between the first end and the second end; and a suction port formed through the sidewall of the housing, and an impeller disposed within the housing between the restrictor device and the venturi nozzle;

deploying the pipe string in the wellbore;

circulating fluid from the surface through the pipe string, wherein a first portion of the fluid entering the passageway at the first end of the housing exits the passageway through the venturi nozzle and the exit port and a second portion of the fluid entering the passageway at the first end of the housing exits the passageway at the second end through the restrictor device, thereby urging the pipe string further into the wellbore; and rotating the housing about the longitudinal axis to draw wellbore fluid into the suction port, around the impeller and out of the housing through the exit port, thereby urging the pipe string further into the wellbore.

13. A method of advancing a pipe string in a wellbore extending from a surface into a region of interest, comprising:

connecting a lateral propulsion tool within the pipe string, the lateral propulsion tool comprising:

a housing having a longitudinal passageway that extends between a first end and a second end of the housing, the housing having a suction port and an exit port formed through a sidewall of the housing; and an impeller disposed in the housing and in fluid communication with the suction port and the exit port;

deploying the pipe string in the wellbore; and rotating the impeller to draw wellbore fluid into the suction port, around the impeller and out of the housing through the exit port, thereby urging the pipe string further into the wellbore.

* * * * *